US011536018B2

(12) United States Patent
Peterson

(10) Patent No.: US 11,536,018 B2
(45) Date of Patent: Dec. 27, 2022

(54) FRAME FOR SECTIONAL FOLDABLE PREFABRICATED BUILDING

(71) Applicant: FOLDING HOLDINGS LLC, Woodinville, WA (US)

(72) Inventor: Elliot Peterson, Woodinville, WA (US)

( * ) Notice: Subject to any disclaimer, the term of this patent is extended or adjusted under 35 U.S.C. 154(b) by 106 days.

(21) Appl. No.: 17/318,929

(22) Filed: May 12, 2021

(65) Prior Publication Data

US 2022/0364353 A1 Nov. 17, 2022

(51) Int. Cl.

| | |
|---|---|
| ***E04B 1/348*** | (2006.01) |
| ***E04B 1/344*** | (2006.01) |
| ***E04B 1/24*** | (2006.01) |
| ***E04B 7/02*** | (2006.01) |
| ***E04B 1/35*** | (2006.01) |
| ***E04B 7/04*** | (2006.01) |

(52) U.S. Cl.

CPC ..... *E04B 1/3483* (2013.01); *E04B 1/2403* (2013.01); *E04B 1/3445* (2013.01); *E04B 1/3533* (2013.01); *E04B 7/022* (2013.01); *E04B 7/045* (2013.01); *E04B 2001/249* (2013.01); *E04B 2001/2415* (2013.01); *E04B 2001/2463* (2013.01); *E04B 2001/3588* (2013.01)

(58) Field of Classification Search

CPC .... E04B 1/3483; E04B 1/2403; E04B 1/3445; E04B 1/3533; E04B 7/022; E04B 7/045; E04B 2001/2415; E04B 2001/2463; E04B 2001/249; E04B 2001/3588

See application file for complete search history.

(56) References Cited

U.S. PATENT DOCUMENTS

| | | | | |
|---|---|---|---|---|
| 2,067,403 A * | 1/1937 | Lea | E04B 1/24 | 52/294 |
| 3,184,012 A * | 5/1965 | Ishimoto | E04B 1/24 | 52/646 |
| 3,296,752 A * | 1/1967 | Philp | E04B 1/3447 | 52/294 |
| 3,690,078 A * | 9/1972 | Maynard, Jr. | E04B 1/3205 | 52/745.07 |
| 3,774,356 A * | 11/1973 | Philp | E04C 3/40 | 52/70 |
| 3,785,108 A * | 1/1974 | Satchell | E04C 3/11 | 52/645 |

(Continued)

*Primary Examiner* — Rodney Mintz

(74) *Attorney, Agent, or Firm* — Keith L. Jenkins, Registered Patent Attorney, LLC; Keith L. Jenkins

(57) ABSTRACT

A frame using tubular columns and tubular rafters of generally rectangular cross section. Columns are arranged parallel, spaced apart, opposed pairs that are connected by bolted-on girts to form wall frames. Rafters are arranged parallel, spaced apart, opposed pairs that are connected by bolted-on purlins to form roof frames. Inwardly facing sides of columns and rafters have pluralities of castellated holes. Outwardly facing sides of columns and rafters have another plurality of castellated holes. All connections for braces and crane lifts are made in the inwardly facing sides of the columns and rafters. Joints have either a ridge plate or a haunch plates, each plate with two bolt holes that may be pivot holes and additional bolt holes for securing the plates. Base plates have two pairs of parallel vertical spaced-apart flanges, each pair fitting within and releasably attachable to a column. Pairs may be arranged parallel or perpendicular.

20 Claims, 15 Drawing Sheets

(56) References Cited

U.S. PATENT DOCUMENTS 3,786,612 A * 1/1974 Baker ..... F16B 12/40 403/295
3,968,618 A * 7/1976 Johnson ..... E04B 1/3441 52/125.4
3,971,185 A * 7/1976 Hendrich ..... E04B 7/24 52/93.2
4,066,089 A * 1/1978 Rainwater ..... E04H 15/48 135/117
4,078,341 A * 3/1978 Peterson ..... E04B 1/3447 52/DIG. 15
4,170,852 A * 10/1979 Danis, Jr. ..... E04B 1/3441 52/745.06
4,219,982 A * 9/1980 Hart ..... E04B 1/3447 52/645
4,479,333 A * 10/1984 Hendrich ..... E04B 7/24 52/645
4,697,393 A * 10/1987 Madray ..... E04B 1/24 52/93.2
4,773,192 A * 9/1988 Andrews ..... E04B 1/24 52/840
5,069,238 A * 12/1991 Marks ..... E04H 15/48 403/92
5,660,005 A * 8/1997 Tacoma ..... E04B 7/022 52/273
5,983,577 A * 11/1999 Hays ..... E04B 1/24 52/693
6,519,900 B1 * 2/2003 Pierce ..... E04B 7/24 52/79.5
6,681,786 B2 * 1/2004 Ju ..... E04H 15/64 135/120.3
6,763,633 B2 * 7/2004 Cote ..... E04B 1/344 52/79.5
7,677,009 B2 * 3/2010 Bowman ..... E04C 3/09 52/645
7,739,841 B1 * 6/2010 Puckett ..... E04C 3/40 52/93.2
7,814,723 B2 * 10/2010 VanElverdinghe ..... E04C 3/07 52/646
8,056,573 B2 * 11/2011 Panigot ..... E04H 15/48 135/147
8,763,315 B2 * 7/2014 Hartman ..... E04H 1/005 52/79.5
8,973,332 B2 * 3/2015 Lee ..... E04B 1/24 52/847
9,222,250 B2 * 12/2015 Peterson ..... E04B 1/34384
10,260,211 B2 * 4/2019 Peterson ..... E04H 1/1205
11,236,500 B2 * 2/2022 Peterson ..... E04C 3/04
2003/0084933 A1 * 5/2003 Ju ..... E04H 15/64 135/120.2
2003/0140577 A1 * 7/2003 Cote ..... E04B 1/3441 135/912
2008/0072946 A1 * 3/2008 VanElverdinghe ..... E04C 3/07 135/122
2008/0083189 A1 * 4/2008 Dulac ..... E04B 1/3445 52/79.5
2008/0178551 A1 * 7/2008 Porter ..... E04B 1/26 52/745.19
2008/0184651 A1 * 8/2008 Bowman ..... E04B 7/022 52/645
2009/0014044 A1 * 1/2009 Hartman ..... E04B 1/34336 135/143
2010/0005749 A1 * 1/2010 Abdel-Sayed ..... E04B 1/24 52/655.1
2010/0229907 A1 * 9/2010 Panigot ..... E04H 15/48 135/144
2014/0123587 A1 * 5/2014 Lee ..... E04B 1/24 52/655.1
2015/0121776 A1 * 5/2015 Peterson ..... E04B 1/3445 52/79.5
2017/0284080 A1 * 10/2017 Vidal de la Fuente ..... E04B 7/022
2017/0342703 A1 * 11/2017 Peterson ..... H01R 24/76
2018/0340310 A1 * 11/2018 Peterson ..... E04H 1/1205
2021/0340752 A1 * 11/2021 Peterson ..... B23P 13/02
2021/0340765 A1 * 11/2021 Yang ..... E04B 1/2403

* cited by examiner

FRAME FOR SECTIONAL FOLDABLE PREFABRICATED BUILDING

BACKGROUND

This invention relates to rapidly deployable rugged building structures. More particularly, it relates to a light-weight foldable prefabricated building frames for making rapidly deployable rugged building sections.

A need exists for improved sturdy building structures. Less weight reduces costs for material and transport, as well as making erection of the prefabricated structures easier, safer, and faster.

OBJECTS AND FEATURES OF THE INVENTION

A primary object and feature of the present invention is to overcome the above-mentioned problems and fulfill the above-mentioned needs. Another object of the invention is to provide weight reduction with castellated holes that also serve to provide tool access for construction of the frame. Another object of the invention is to provide weight reduction with castellated holes that also serve to provide tool access for construction of the frame and packaging access.

SUMMARY OF THE INVENTION

In accordance with a preferred embodiment hereof, this invention provides a foldable sectional frame having tubular columns and rafters (beams, collectively) of generally rectangular cross section and having castellated holes on opposing long sides of the rectangular tubular beams. The castellated holes may be of any shape that serves the objectives of the invention. The columns and rafters are provided with fastener holes for installing girts and purlins, respectively, and additional holes as for crane cable attachment points.

BRIEF DESCRIPTION OF THE DRAWINGS

The following figures illustrate a preferred embodiment of the present invention.

DETAILED DESCRIPTION OF THE INVENTION

As used and defined herein, "exterior" means the outward facing sides of the columns 110, 112, 164, and 170 and rafters 124, 126, 144, and 146 of the improved foldable prefabricated building section frame 100 and "interior" means the inward facing sides of the columns 110, 112, 164, and 170 and rafters 124, 126, 144, and 146. Like reference numbers indicate like objects, and the hundred's digits of the reference number indicate the figure number where that object is first labeled. As used and defined herein, the term "haunch" refers to stabilizing members between columns and rafters. As used and defined herein "castellated" refers to holes cut in the wider sides of columns and rafters.

Figure 1:
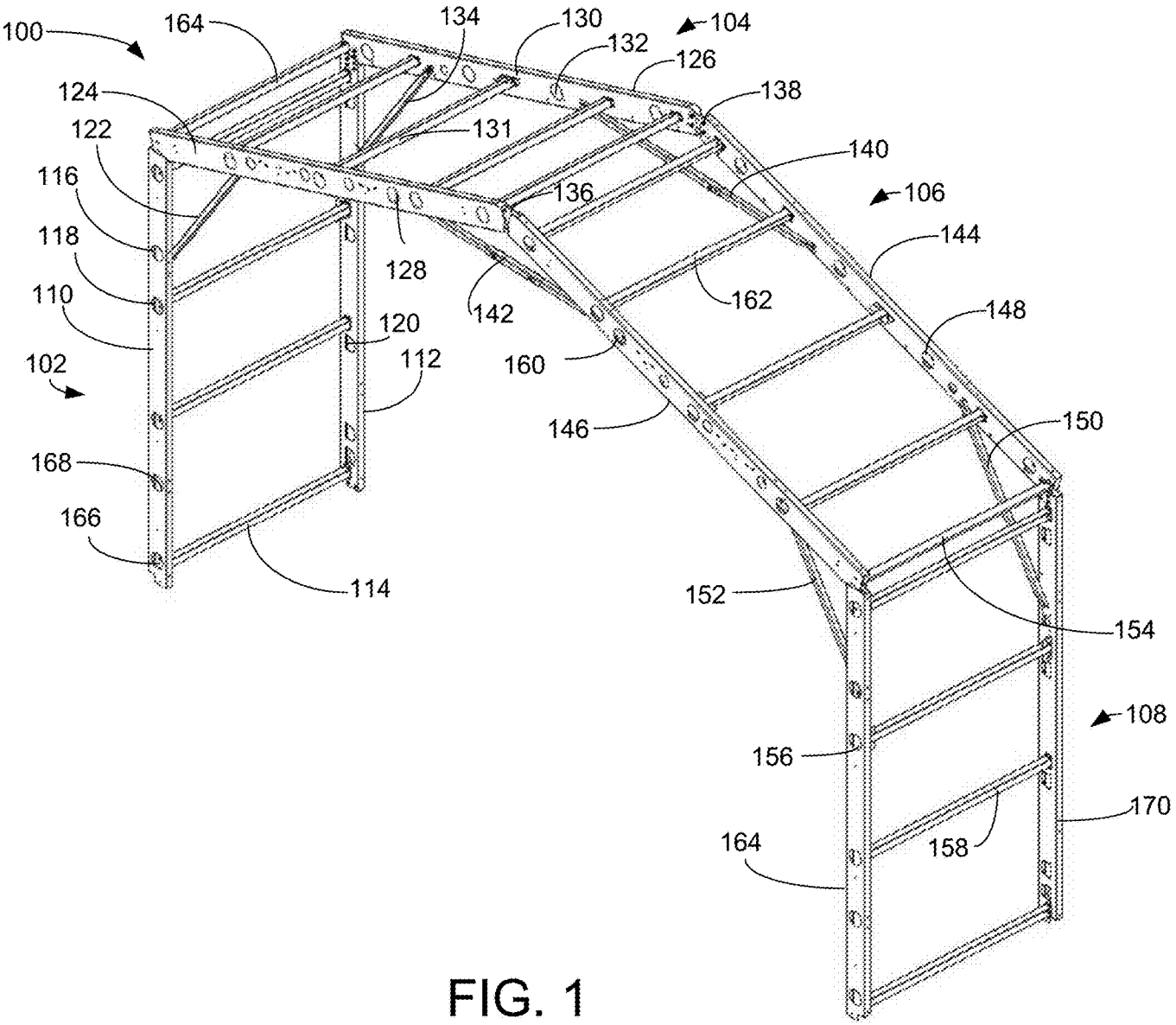
FIG. 1 is a perspective view illustrating an exemplary embodiment of an improved foldable prefabricated building section frame, according to a preferred embodiment of the present invention.

FIG. 1 is a perspective view illustrating an exemplary embodiment of an improved foldable prefabricated building section frame 100, according to a preferred embodiment of the present invention. The improved foldable prefabricated building section frame 100 includes a first wall frame 102, a first roof frame 104, a second roof frame 106, and a second wall frame 108, sequentially connected by means which can secure the frame in the folded or in the erected configuration, as shown. First wall frame 102 includes two opposed spaced apart parallel columns 110 and 112 connected by four bolted-on girts 114 (one of four labeled). Column 110 has castellated holes 116, 118, 166, and 168 (four of six labeled) on the exterior side for providing weight reduction and tool access, and which provide fastener access for securing girts 114 (one of four labeled). Each castellated hole 116, 118, 166, and 168 (four of six labeled) has a mostly circular perimeter comprising at least 250 angular degrees and a flat side that is a chord of the mostly circular perimeter. This shape is not a limitation of the invention, as holes of various functional shapes are within the scope of the present invention. The flat side is oriented parallel to a long side of the column 110 or 112, and is the same for rafters 124, 126, 144, and 146. Column 112 has castellated holes 120 (one of three visible of four labeled) on its interior side that are not aligned to the castellated holes 116, 118, 166, and 168 (four of six labeled) of column 110. Castellated holes 116, 118, 166, and 168 (four of six labeled) are generally aligned in a linear array on each wide side of each column 110 and 112 and each wide side of each rafter 144 and 146. In various embodiments, the array is not linear.

First roof frame 104 includes two opposed spaced apart parallel rafters 124 and 126. The tops of columns 110 and 112 are connected to rafters 124 and 126, respectively, by means that will be discussed in detail below. Rafters 124 and 126 are connected by bolted-on purlins 164 and 131 (two of five labeled). Haunch braces 122 and 134 provide additional stabilization of the structure by rigidly extending from column 110 to rafter 124 and from column 112 to rafter 126, respectively. Rafter 124 illustrates exterior castellated holes 128 (one of four labeled). Rafter 126 illustrates interior castellations 132 (one of four labeled).

Second roof frame 106 includes two opposed spaced apart parallel rafters 144 and 146 that are connected to rafters 124 and 126, respectively, via ridge plates 136 and 138, respectively. Ridge brace 142 further stabilizes the rafters 124 and 146, while ridge brace 140 stabilizes the rafters 126 and 144. Rafters 144 and 146 are connected by bolted-on purlins 162 and 154 (two of five labeled). Rafter 146 shows exterior castellated holes 160 (one of five labeled). Rafter 144 shows interior castellated holes 148 (one of four labeled).

Second wall frame 108 includes two opposed spaced apart parallel columns 164 and 170 connected by four bolted-on girts 158 (one of four labeled). Rafters 146 and 144 connect to columns 164 and 170 via means to be discussed in detail below. Haunch brace 152 stabilizes the joint between rafter 146 and column 164 while haunch brace 150 stabilizes the joint between rafter 144 and column 170.

Ridge plates 136 and 138 allow the roof frames 104 and 106 to fold for transport with the top sides of the rafters 124 and 126 to abut top sides of rafters 146 and 144, respectively. Corner joints allow the wall frames 102 and 108 to fold to abut their interior surfaces to undersides of roof frames 104 and 106, respectively.

In additional embodiments, more or fewer purlins and girts may be used and respective more or fewer castellated holes may be used. It is preferable that the length of the columns and the lengths of the rafters be approximately equal to provide best storage and shipping efficiency. The castellated holes have the benefit of reducing weight of the frame 100 without noticeably reducing the strength. The castellated holes also assist in ease of manufacture, and therefore, reduced labor costs. The castellated holes also provide tool access for fastening frames 100 together, side-by-side, to form a building frame.

Figure 2:
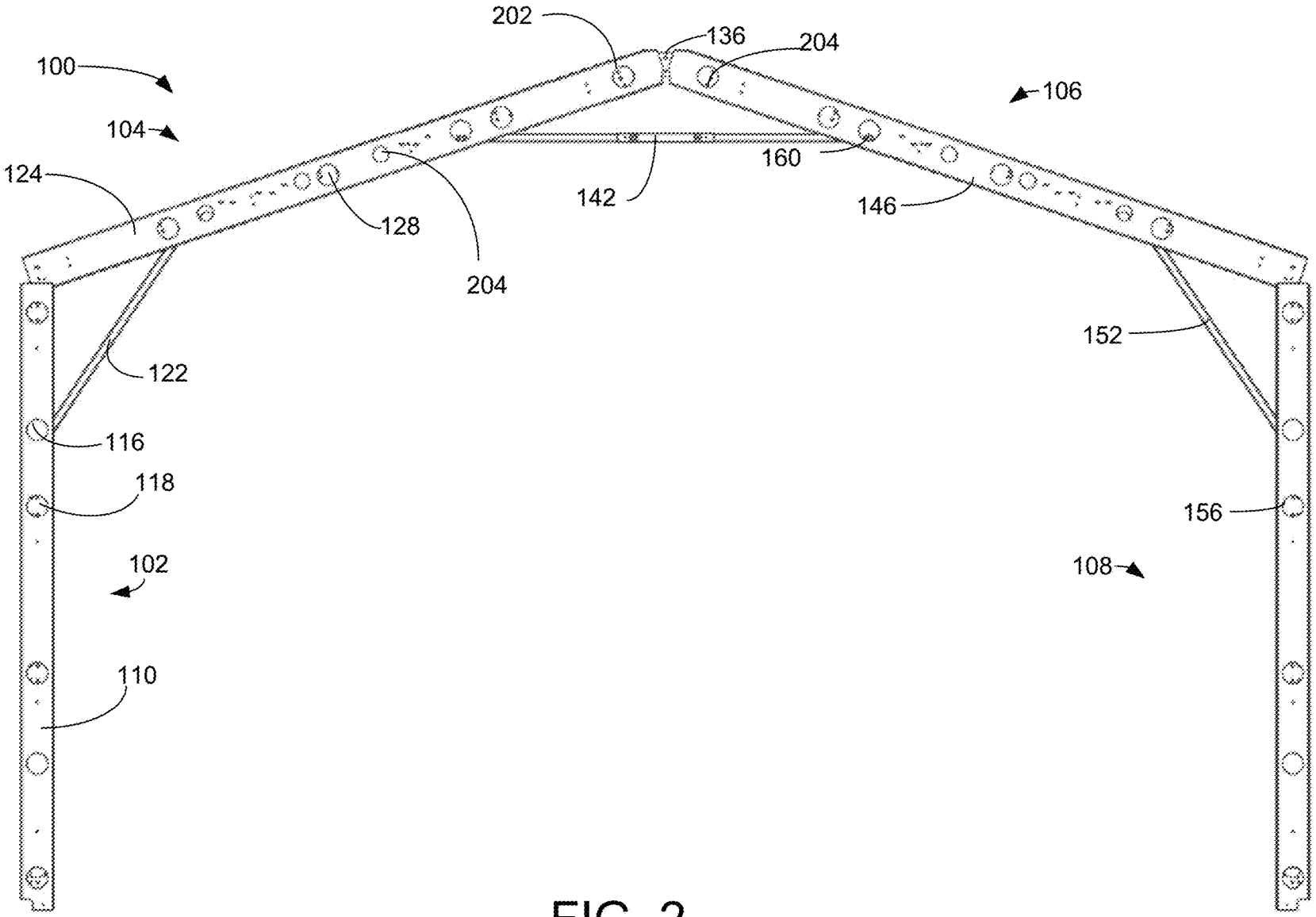
FIG. 2 is a front elevation view illustrating an exemplary embodiment of the improved foldable prefabricated building section frame of FIG. 1, according to a preferred embodiment of the present invention.

FIG. 2 is a front elevation view illustrating an exemplary embodiment improved foldable prefabricated building section frame 100 of FIG. 1, according to a preferred embodiment of the present invention. Castellated holes 202 and 204 provide fastener tool operation access for securing bolted-on purlins (two unlabeled and 131 and 162).

Figure 3:
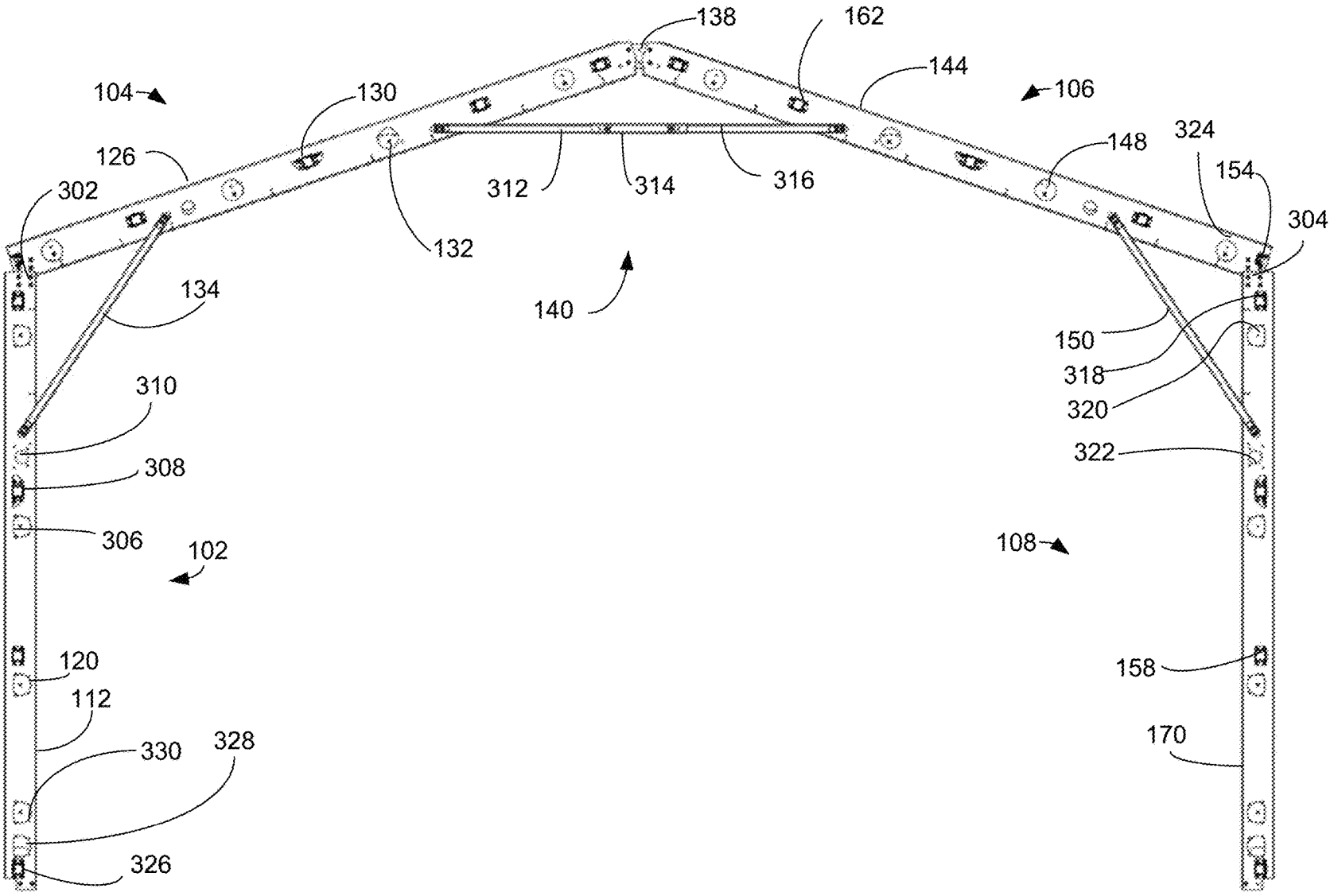
FIG. 3 is an interior elevation view illustrating an exemplary embodiment of the improved foldable prefabricated building section frame of FIG. 1, according to a preferred embodiment of the present invention.

FIG. 3 is an interior elevation view illustrating an exemplary embodiment improved foldable prefabricated building section frame 100 of FIG. 1, according to a preferred embodiment of the present invention. Haunch plate bolts 302 connecting column 112 to rafter 126 are first visible in this view. Haunch plate bolts 304 connecting column 170 to rafter 144 are also first visible in this view. Interior castellated hole 306 and 310 (two labeled of four) is referenced for further discussion below. Girt ends 308 and 326 (two of four labeled) in column 112 provide connectivity for girts 114 (one of four labeled in FIG. 1).

Ridge brace 140 is shown in three sections: left section 312, right section 316 and sleeve 314. Girt ends 318 and 158 (two labeled of four) and castellated hole 320 (one labeled of four) in column 170 are referenced for further discussion below.

Figure 4:
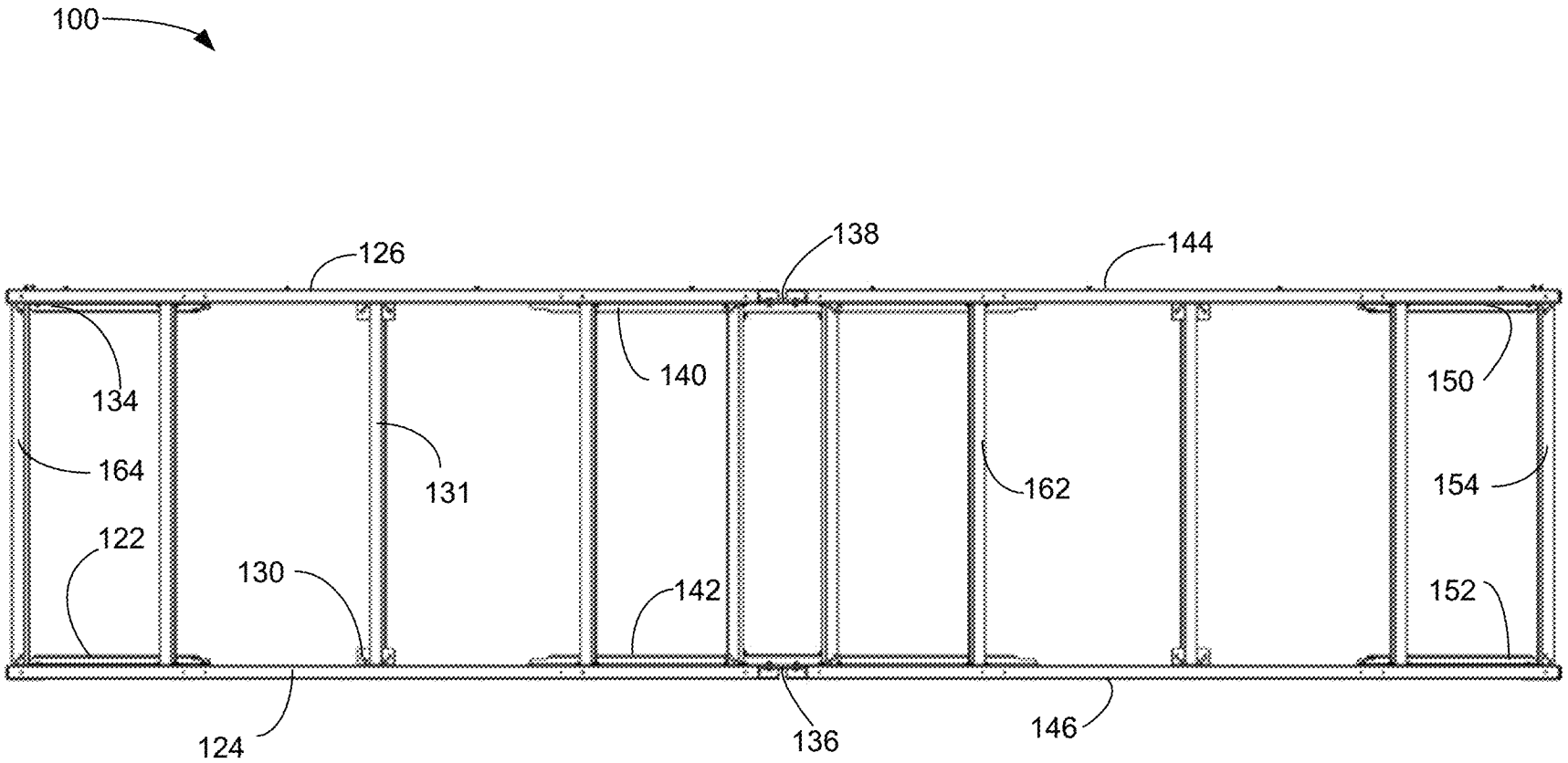
FIG. 4 is a top plan view of the exemplary embodiment illustrating the foldable prefabricated building section frame of FIG. 1, according to a preferred embodiment of the present invention.

FIG. 4 is a top plan view of the exemplary embodiment illustrating the foldable prefabricated building section frame 100 of FIG. 1, according to a preferred embodiment of the present invention. A different perspective on the girt ends 130 (one of eight labeled). The position of the ridge plates 136 and 138 on the interior surfaces of rafters is further clarified.

Figure 5:
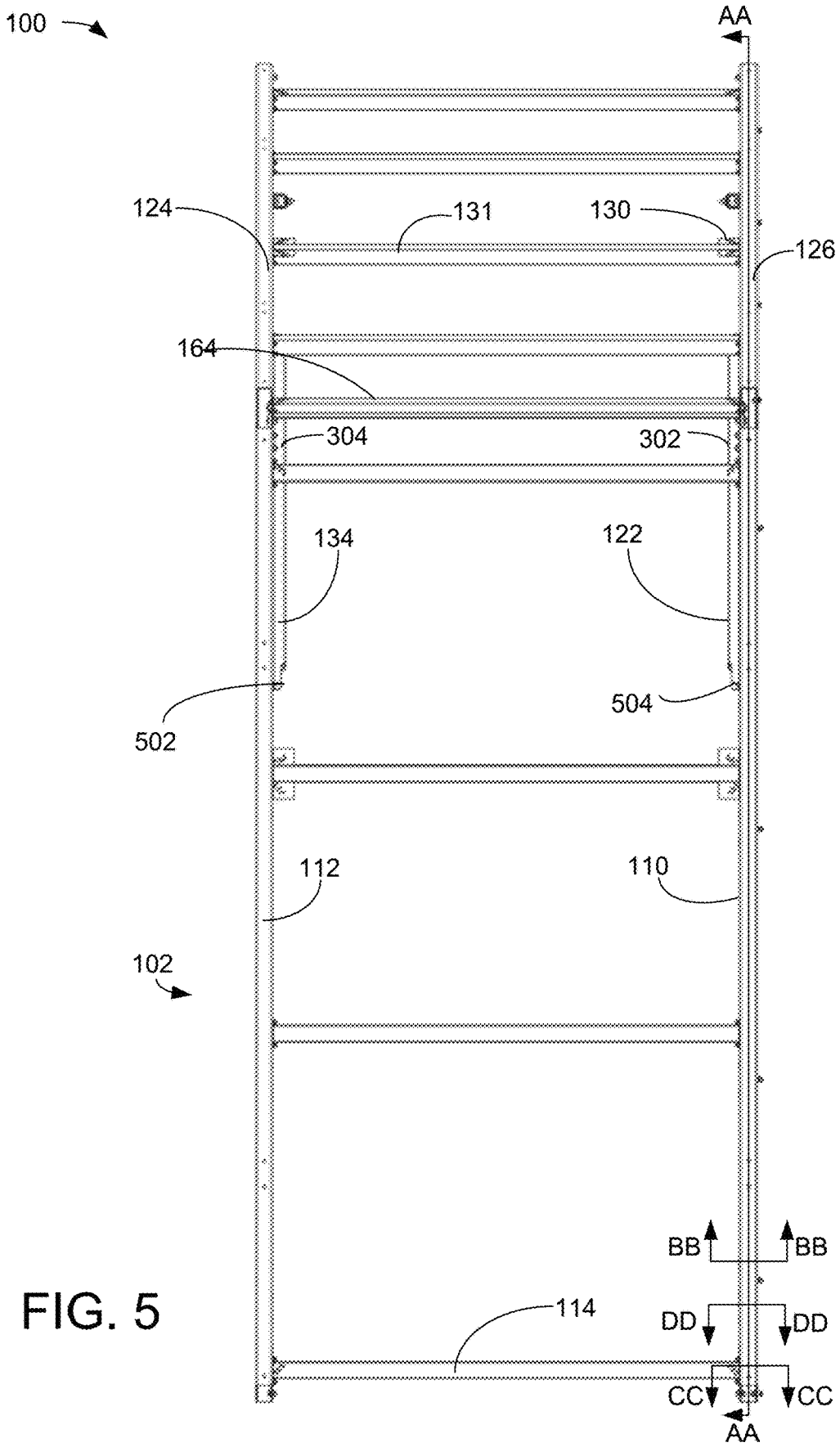
FIG. 5 is a side elevation view of the exemplary embodiment illustrating the improved foldable prefabricated building section frame of FIG. 1 and defining cross sections AA, BB, CC, and DD, according to a preferred embodiment of the present invention.

FIG. 5 is a side elevation view of the exemplary embodiment illustrating the improved foldable prefabricated building section frame 100 of FIG. 1 and defining cross sections AA, BB, CC, and DD, according to a preferred embodiment of the present invention. Girts 114 are bolted into the columns 110 and 112 and purlins 131 are bolted into the rafters 124 and 126. Haunch brace 134 is secured to column 112 via bolts 502. Haunch brace 122 is secured to column 110 via bolts 504.

Figure 6:
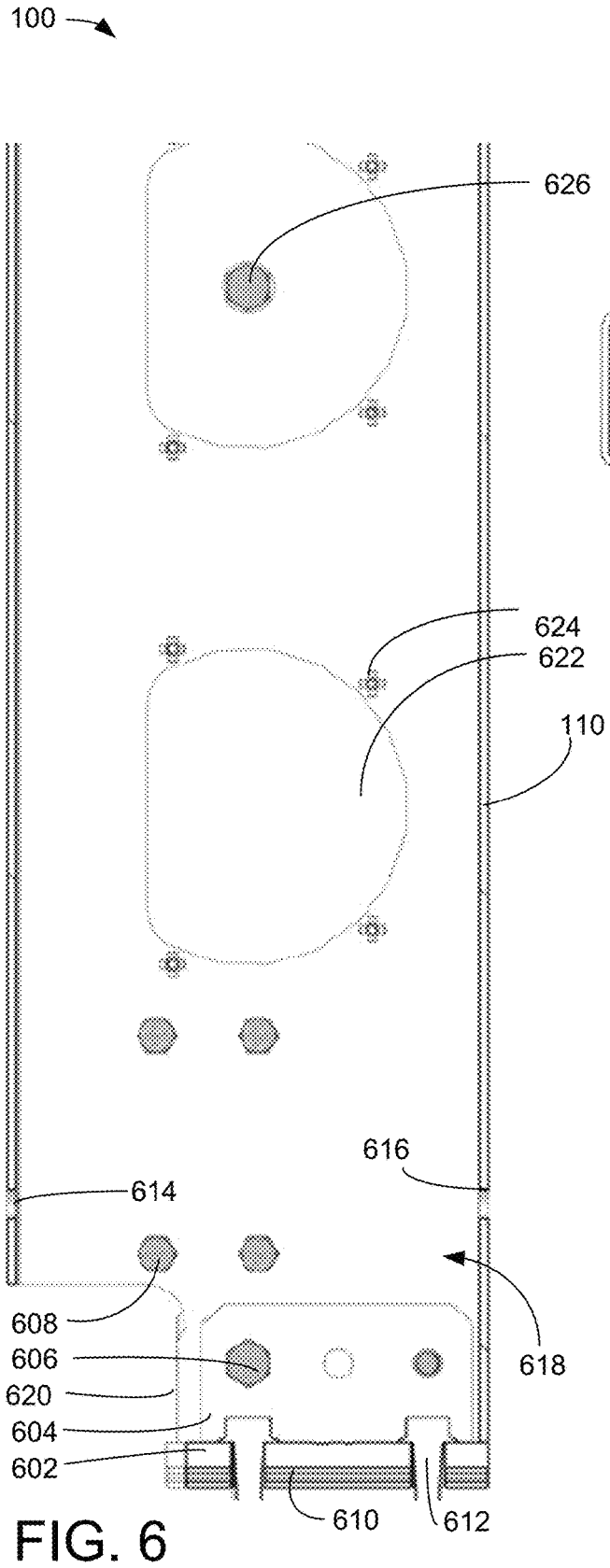
FIG. 6 is a detailed longitudinal cross section elevation view through cross section AA of FIG. 5 illustrating an exemplary embodiment of an exemplary bottom portion of a column of the improved foldable prefabricated building section frame of FIG. 1, according to a preferred embodiment of the present invention.

FIG. 6 is a detailed longitudinal cross section along cross section AA elevation view illustrating an exemplary embodiment of an exemplary bottom portion of a column of the exemplary embodiment of the improved foldable prefabricated building section frame of FIG. 1, according to a preferred embodiment of the present invention. Base plate 602 rests on a concrete footing 610 (shown thinner than actual use, for simplicity of the drawing) and bolted into that concrete footing 610 using bolts 612 (one of two labeled). In a particular embodiment, a concrete foundation, such as, without limitation, a concrete slab, may substitute for concrete footing 610. In some embodiments, similarly functional materials other than concrete may be used. Vertical base plate flange 604 is bolted 606 (one of three bolt holes used) to the interior surface 618 column 110. Bolts 608 (one of four labeled) hold a girt 114 (not visible in this view) in place. Holes 614 and 616 are for packaging.

Figure 7:
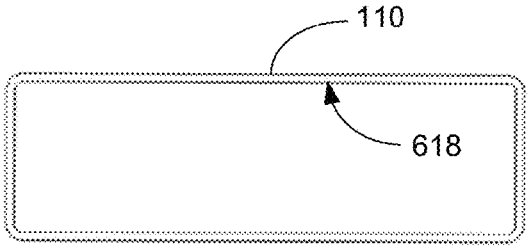
FIG. 7 is a cross sectional view through cross section BB of FIG. 5 illustrating the exemplary embodiment of the improved foldable prefabricated building section frame of FIG. 1, according to a preferred embodiment of the present invention.

FIG. 7 is a cross sectional view through cross section BB of FIG. 5 illustrating the exemplary embodiment of the improved foldable prefabricated building section frame 100 of FIG. 1, according to a preferred embodiment of the present invention. The cross section of the column 110 is the same for all columns and slightly larger than for rafters.

Figure 8:
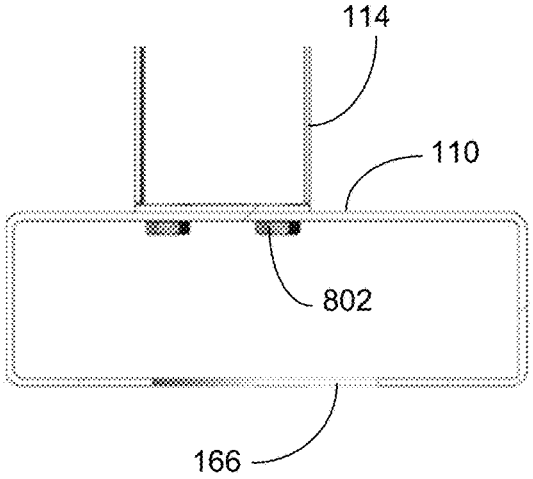
FIG. 8 is a cross sectional view through cross section CC of FIG. 5 illustrating the exemplary embodiment of the improved foldable prefabricated building section frame of FIG. 1, according to a preferred embodiment of the present invention.

FIG. 8 is a cross sectional view through cross section CC of FIG. 5 illustrating the exemplary embodiment of the improved foldable prefabricated building section frame 100 of FIG. 1, according to a preferred embodiment of the present invention. Cross section CC shows castellated hole 166 and girt 114. Interior surface 618 is also visible. Girt bolt heads 802 (one of two labeled) are visible in this view.

Figure 9:
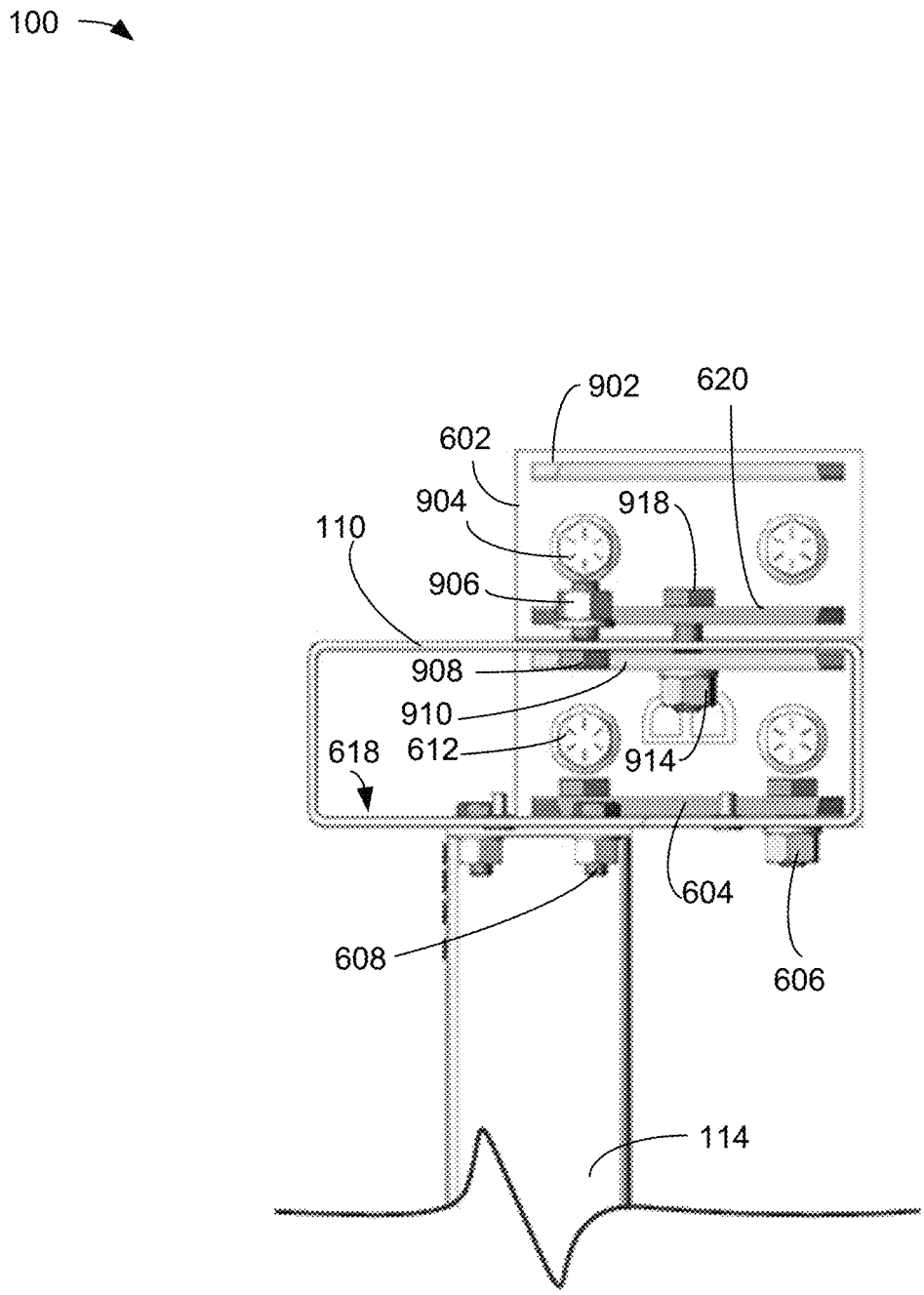
FIG. 9 is a cross sectional view through cross section DD of FIG. 5 with an exemplary base plate and an exemplary girt illustrating the exemplary embodiment of the improved foldable prefabricated building section frame of FIG. 1, according to a preferred embodiment of the present invention.

FIG. 9 is a transverse cross-sectional view through column 110 with an exemplary base plate 602 and an exemplary girt 114 illustrating the exemplary embodiment of the improved foldable prefabricated building section frame 100 of FIG. 1, according to a preferred embodiment of the present invention. Baseplate 602 extends underneath column 110. The external portion of base plate 602 has a first pair of flanges, including an outer vertical flange 902 and an inner vertical flange 620 flanking bolts 904 (one of two labeled) that extend through baseplate 602 and into concrete footing 610 (see FIG. 6). Inner vertical flange 620 is bolted to column 110 via bolt 918 and nut 914 and to interior vertical flange 910 by bolts 908 and 918 with nuts 906 and 914, respectively. The internal portion of base plate 602 has a second pair of vertical flanges parallel to the first pair and including an inside vertical flange 910 and an opposed vertical flange 604 guarding bolts 612 (one of two labeled) that extend through baseplate 602 and into concrete footing 610 (see FIG. 6). Inside vertical flange 910 abuts an internal surface 618 of column 110. Opposed vertical flange 604 abuts an opposing inner surface 618 of column 110. Opposed vertical flange 604 is bolted to column 110 via bolts 606 (one of two labeled). Girt 114 is bolted to column 110 via bolts 608 (one of two labeled).

Figure 10:
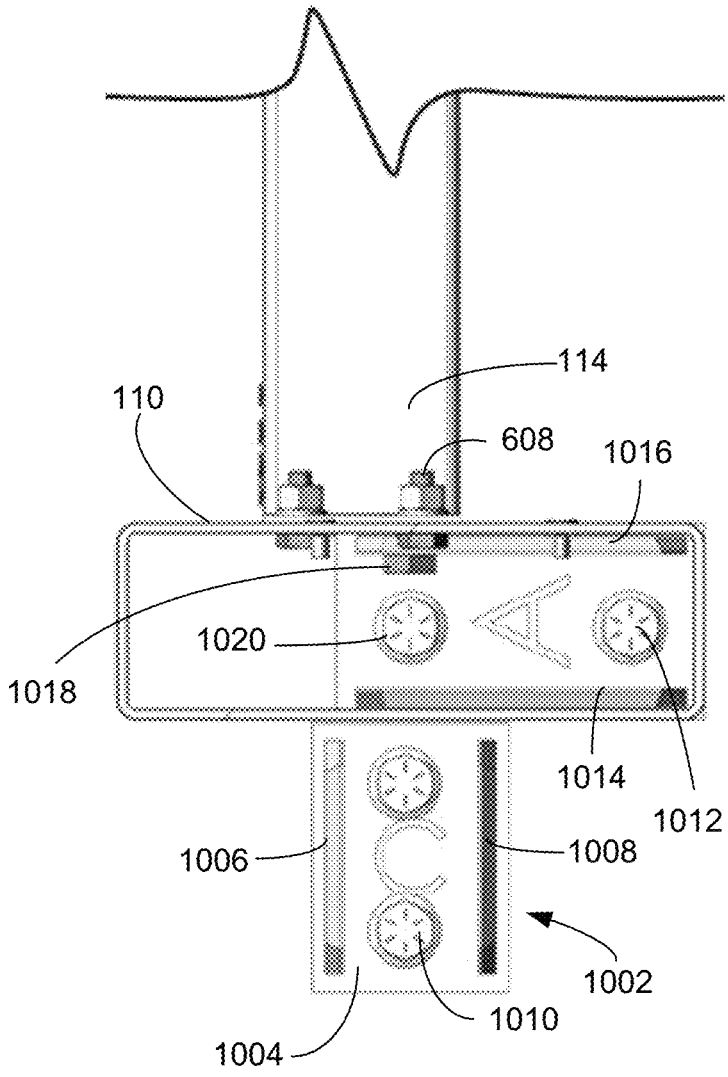
FIG. 10 is a cross sectional view through cross section DD of FIG. 5 with a second type of exemplary base plate and an exemplary girt illustrating the exemplary embodiment of the improved foldable prefabricated building section frame of FIG. 1, according to a preferred embodiment of the present invention.

FIG. 10 is a transverse cross-sectional view illustrating a second type of exemplary base plate 1004 and an exemplary girt 114 of the exemplary embodiment of the improved foldable prefabricated building section frame 100 of FIG. 1, according to a preferred embodiment of the present invention. Base plate 1004 extends underneath a portion of column 110 and has four vertical flanges 1006, 1008, 1014, and 1016 extending therefrom. External portion 1002 of baseplate 1004 supports a first pair of opposed spaced-apart vertical flanges 1006 and 1008 flanking bolts 1010 (one of two labeled) that extend through base plate 1004 and into a concrete footing 610. Internal portion of baseplate 1004 supports a second pair of vertical flanges including vertical flanges 1014 and 1016. The second pair of vertical flanges is perpendicular to the first pair. Vertical flange 1014 abuts an inside surface 618 of column 110 and vertical flange 1016 abuts an opposing inside surface 618 of column 110. Vertical flanges 1014 and 1016 have beveled top edges to assist in sliding column 110 down onto baseplate 1004 during building construction. Bolts 1020 and 1012 extend through baseplate 1004 and into concrete footing. The concrete footing 610 may be, in some cases, a concrete slab large enough to support all columns and, in other cases, may be discrete footings, as needed. Bolt 1018 fastens column 110 to baseplate 1004 via vertical flange 1016. Bolts 608 (one labeled of two shown of four) fasten girt 114 to column 110.

Figure 11:
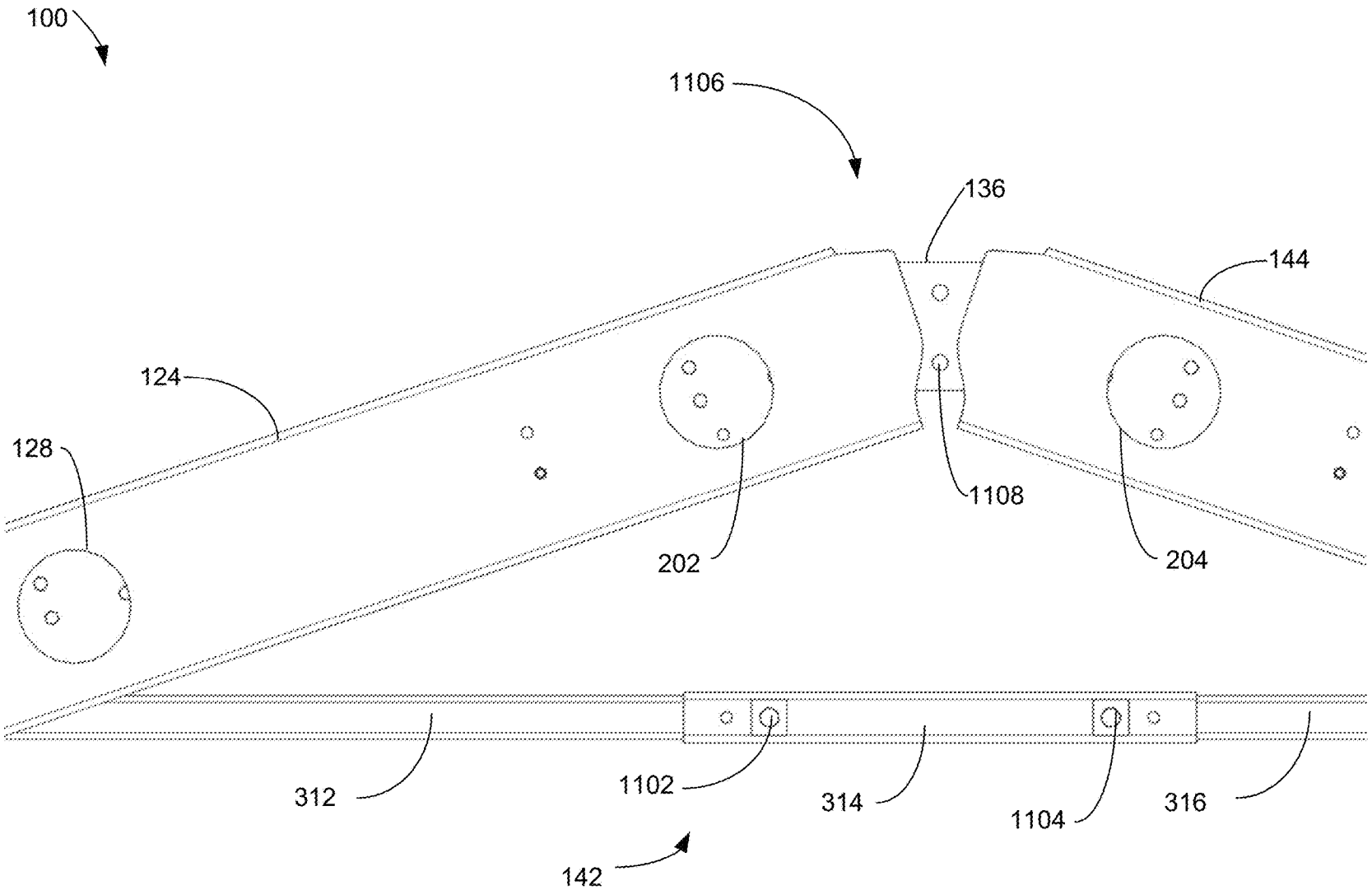
FIG. 11 is an exterior elevation view illustrating an exemplary roof ridge of the improved foldable prefabricated building section frame of FIG. 1, according to a preferred embodiment of the present invention.

FIG. 11 is an exterior elevation view illustrating an exemplary roof ridge 1104 of the improved foldable prefabricated building section frame 110 of FIG. 1, according to a preferred embodiment of the present invention. Ridge brace sleeve has two fasteners 1102 and 1104, to secure the ridge brace 142 in place during construction. Ridge plate 136 has two holes 1108 (one of two labeled) for receiving lifting apparatus during erection of the frame 100.

Figure 12:
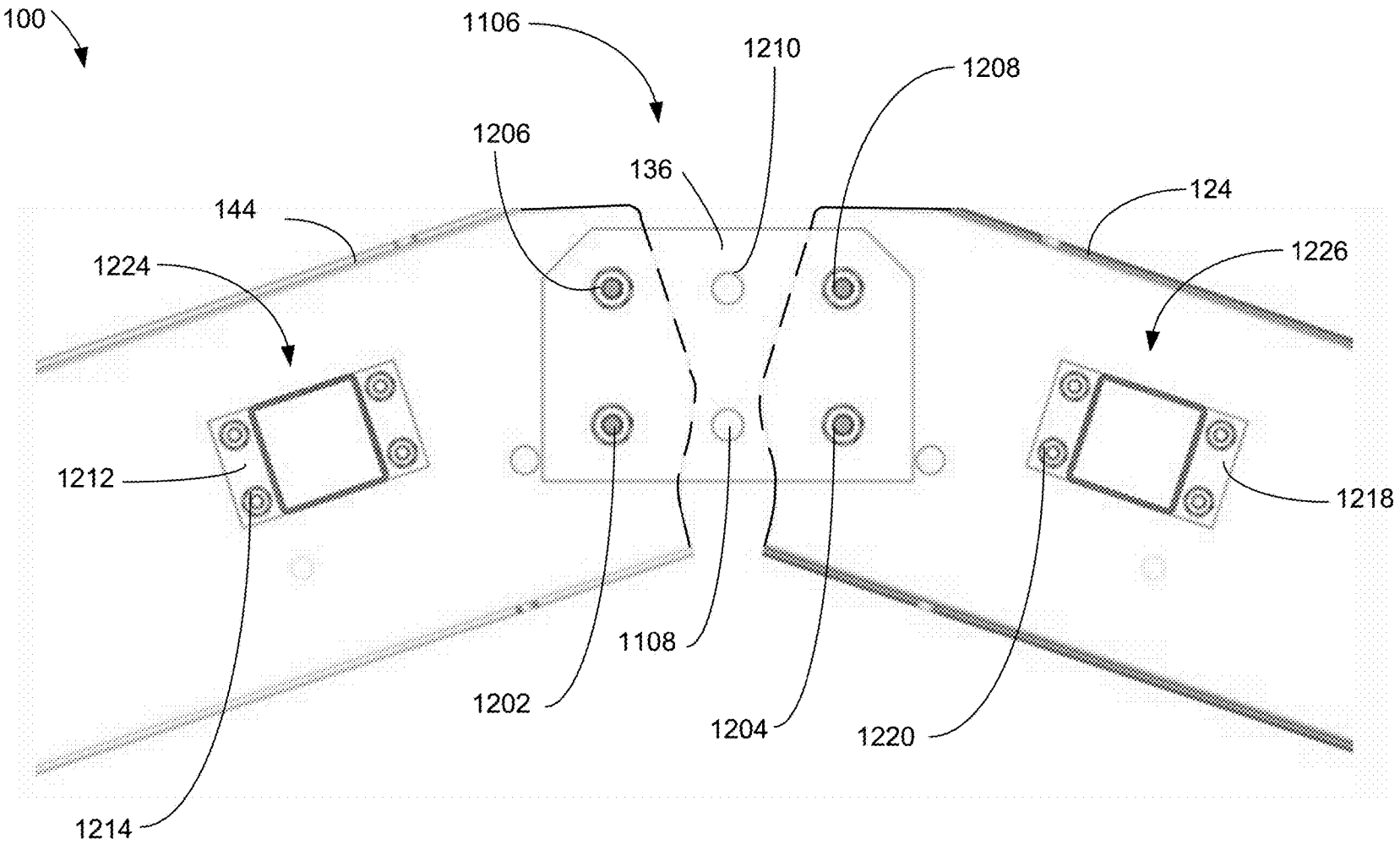
FIG. 12 is an interior elevation view illustrating an exemplary roof ridge of the improved foldable prefabricated building section frame of FIG. 1, according to a preferred embodiment of the present invention.

FIG. 12 is an interior elevation view illustrating an exemplary roof ridge 1106 of the improved foldable prefabricated building section frame 110 of FIG. 1, according to a preferred embodiment of the present invention. Bolts 1206 and 1208 are loosened, with bolts 1202 and 1204 removed, to pivot rafters 144 and 124 during storage and transportation. Once erected by lifting using holes 1210 and 1108 and a lifting apparatus, bolts 1202 and 1204 are inserted, and all bolts 1202, 1204, 1206, and 1208 are tightened.

Purlin end 1224 has flanges 1212 (one of two labeled) with fastener openings for four bolts 1214 (one of four labeled). Purlin end 1226 has opposing flanges 1218 (one of two labeled) with fastener openings for four bolts 1220 (one of four labeled).

Figure 13:
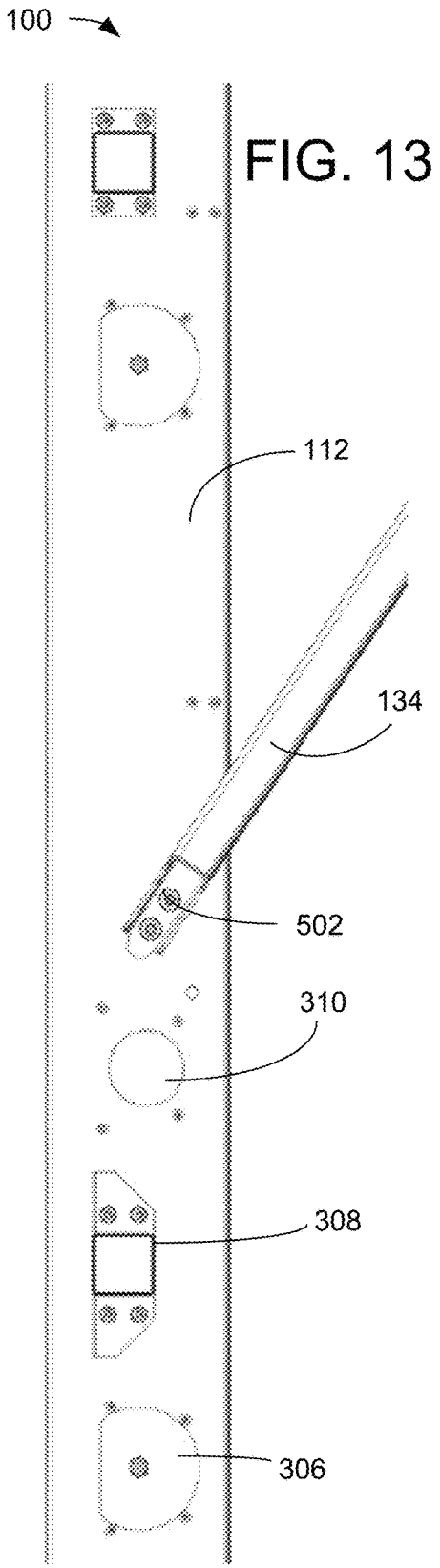
FIG. 13 is an interior elevation view illustrating exemplary details of the exemplary haunch brace of the exemplary embodiment of the improved foldable prefabricated building section frame of FIG. 1, according to a preferred embodiment of the present invention.

FIG. 13 is an interior elevation view illustrating exemplary details of the exemplary haunch brace 134 of the exemplary embodiment of the improved foldable prefabricated building section frame 100 of FIG. 1, according to a preferred embodiment of the present invention. Haunch brace 134 is disconnected during shipping and then secured to column 112 vis two bolts 502 (one of two labeled) during erection of the frame 100.

Figure 14:
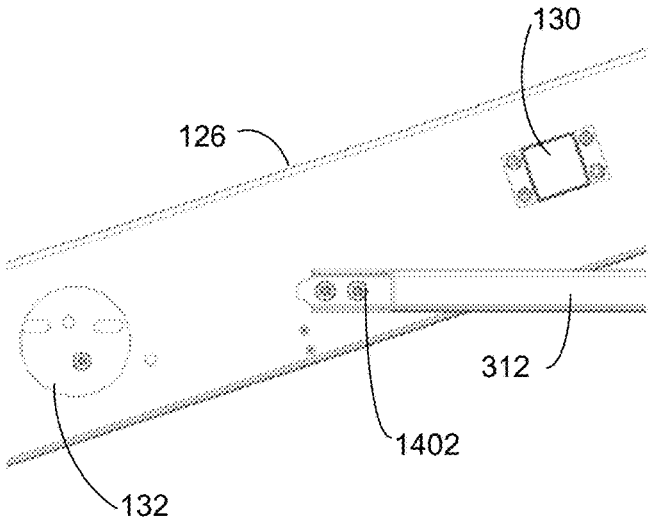
FIG. 14 is an interior elevation view illustrating exemplary details of the exemplary ridge brace of the exemplary embodiment of the improved foldable prefabricated building section frame of FIG. 1, according to a preferred embodiment of the present invention.

FIG. 14 is an interior elevation view illustrating exemplary details of the exemplary ridge brace of the exemplary embodiment of the improved foldable prefabricated building section frame 100 of FIG. 1, according to a preferred embodiment of the present invention. Ridge brace section 312 is secured to rafter 126 using two bolts 1402 (one of two labeled). During building construction one bolt 1402 is used as a pivot and the same is done with section 316. When the walls and roof panels are properly positioned, the sleeve 314, riding on one of the ridge brace sections 312 or 316, is slid into position, and all ridge brace bolts 1402 are fastened.

Figures 15, 16:
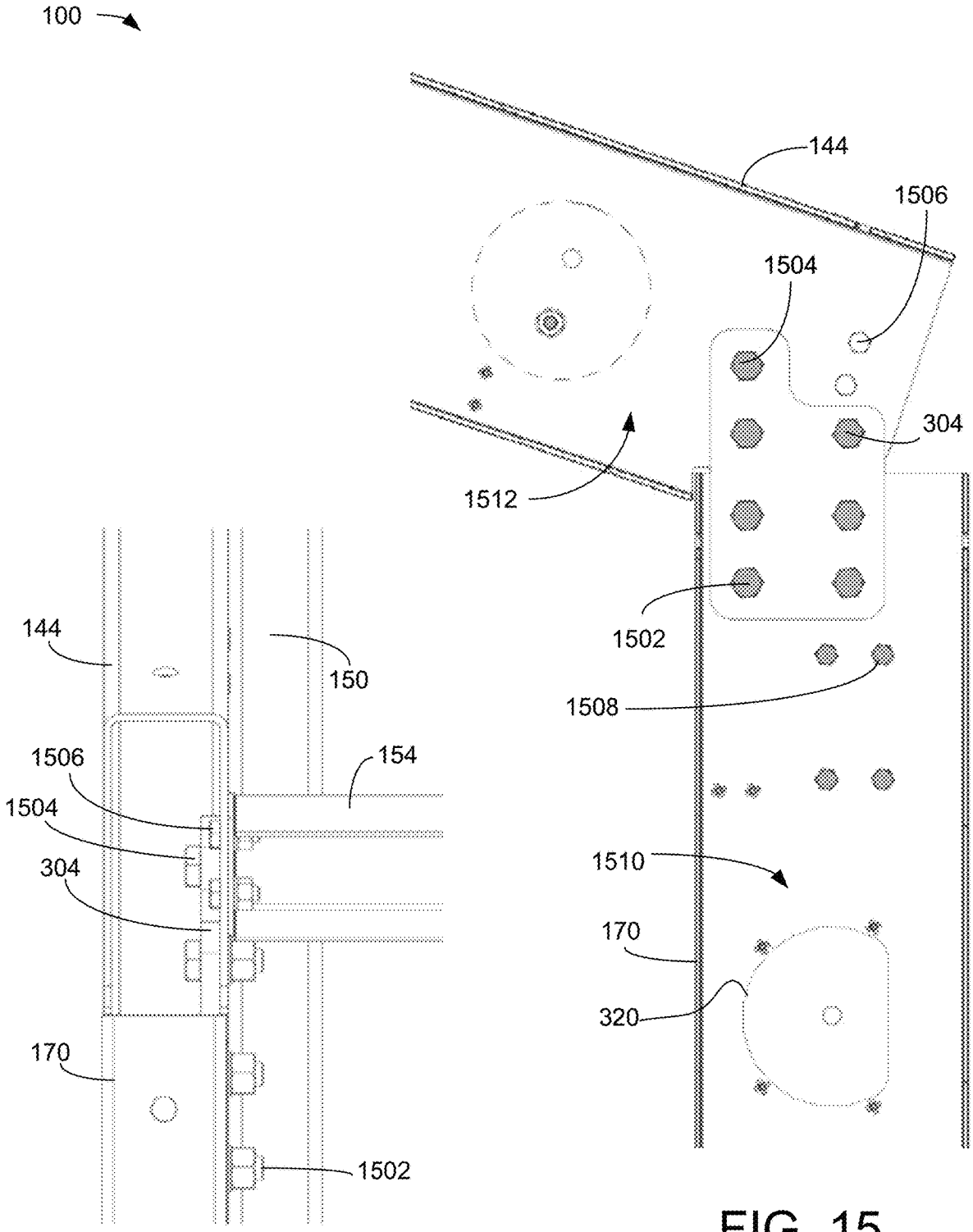
FIG. 15 is a longitudinal cross-sectional view illustrating exemplary details of the exemplary haunch plate of the exemplary embodiment of the improved foldable prefabricated building section frame of FIG. 1, according to a preferred embodiment of the present invention.
FIG. 16 is a side view illustrating exemplary details of the exemplary haunch plate of the exemplary embodiment of the improved foldable prefabricated building section frame of FIG. 1, according to a preferred embodiment of the present invention.

FIG. 15 is a longitudinal cross-sectional view illustrating exemplary details of the exemplary haunch plate 304 of the exemplary embodiment of the improved foldable prefabricated building section frame 100 of FIG. 1, according to a preferred embodiment of the present invention. Haunch plate 304 is fastened against the interior surface 1512 of tubular rafter via three bolts 1504 (one of three labeled) and is fastened against the interior surface 1510 of tubular column 170 via four bolts 1502 (one of four labeled) Haunch plate 304 has openings for seven bolts 1502 and 1504 (two of seven labeled). Bolts 1504 and 1502 are used as pivot points during transport and erection of the building, with the other five bolts omitted until the wall and roof panels are correctly positioned. Openings 1506 (one of two labeled) are for securing bolted-on purlin 154. Bolts 1508 (one of four labeled) secure the top girt 158.

FIG. 16 is a side view illustrating exemplary details of the exemplary haunch plate 304 of the exemplary embodiment of the improved foldable prefabricated building section frame 100 of FIG. 1, according to a preferred embodiment of the present invention. The open end of tubular rafter 144 provides tool access to the haunch plate 304.

Figure 17:
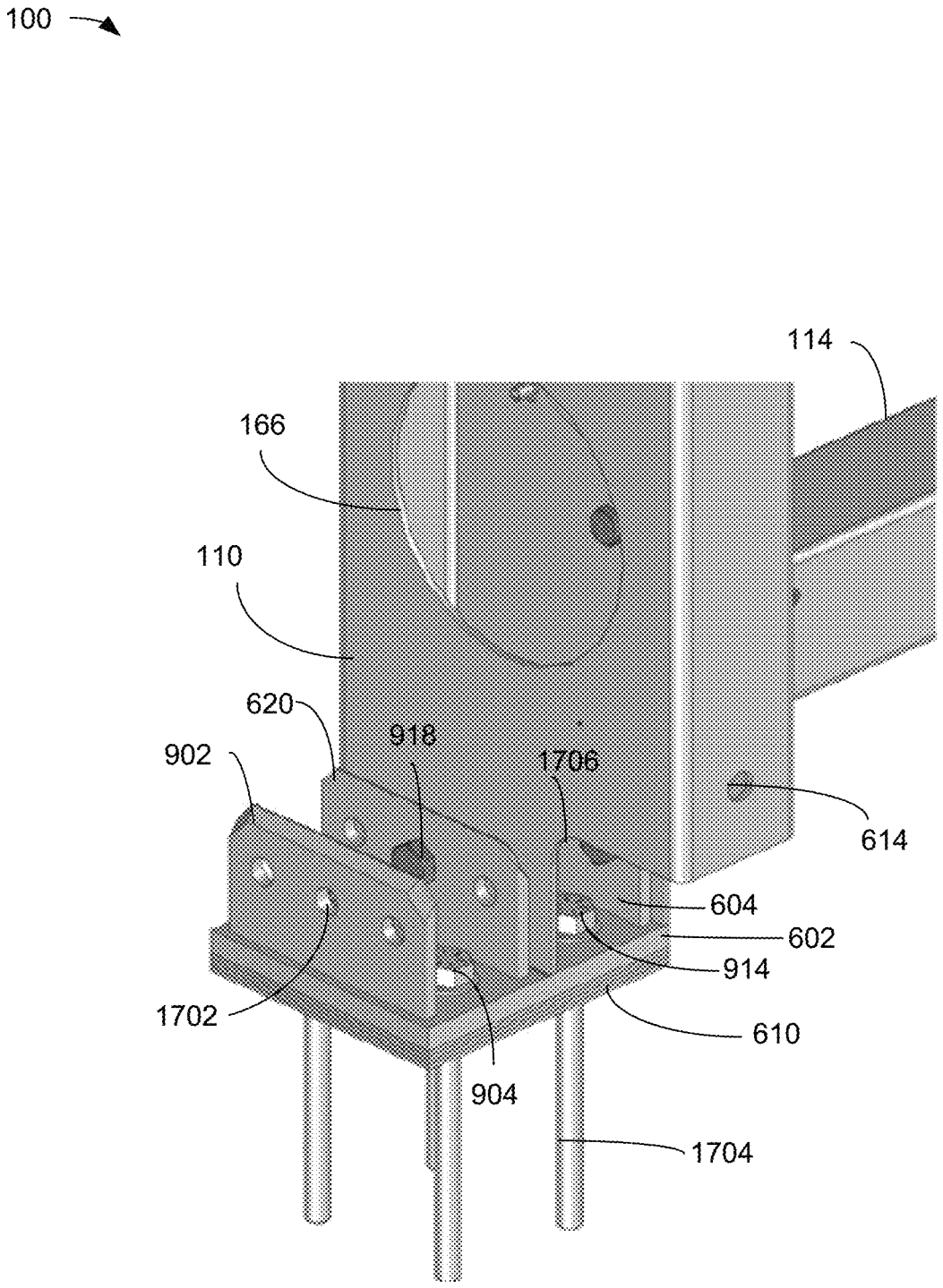
FIG. 17 is a perspective rendered view illustrating an exemplary first type of base plate engaged to an exemplary bottom end of an exemplary column of the exemplary embodiment of the improved foldable prefabricated building section frame of FIG. 1, according to a preferred embodiment of the present invention.

FIG. 17 is a rendered perspective view illustrating an exemplary first type of base plate 602 engaged to an exemplary bottom end of an exemplary column 110 of the exemplary embodiment of the improved foldable prefabricated building section frame 100 of FIG. 1, according to a preferred embodiment of the present invention. Bight 1706 provides tool access to connect column 110 to baseplate 602. Bolt 914 has a long shaft 1704 to serve as an anchor bolt 914. Opening 1702 may be used to connect a second column, installed immediately beside column 110 to vertical flange 902 with bolt 918 doing double duty to connect the second column to vertical flange 620 and to column 110.

Figure 18:
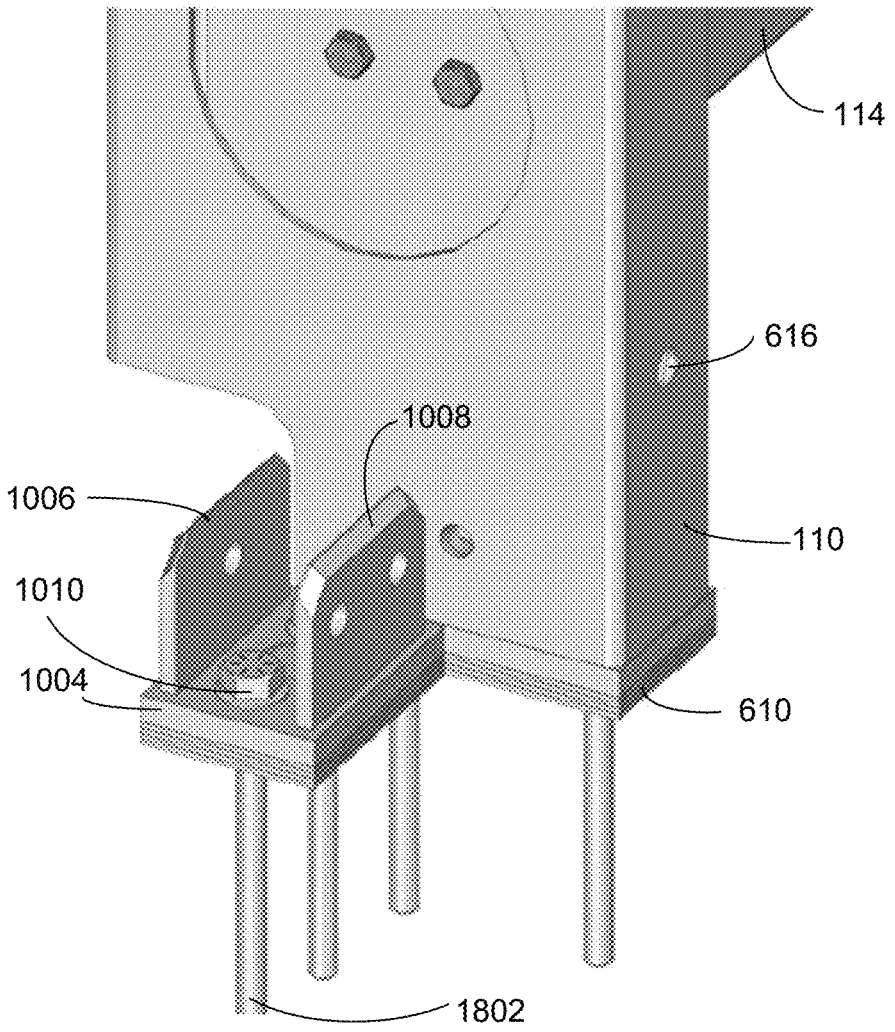
FIG. 18 is a perspective view illustrating an exemplary second type of base plate engaged to an exemplary bottom end of an exemplary column of the exemplary embodiment of the improved foldable prefabricated building section frame of FIG. 1, according to a preferred embodiment of the present invention.

FIG. 18 is a perspective view illustrating an exemplary second type of base plate 1004 engaged to an exemplary bottom end of an exemplary column 110 of the exemplary embodiment of the improved foldable prefabricated building section frame 100 of FIG. 1, according to a preferred embodiment of the present invention. Anchor bolt 1010 has a long shaft 1802, as do all anchor bolts. Vertical flanges 1006 and 1008 may be used to receive a second column at a right angle to column 110 and to secure that second column to baseplate 1004.

Figure 19:
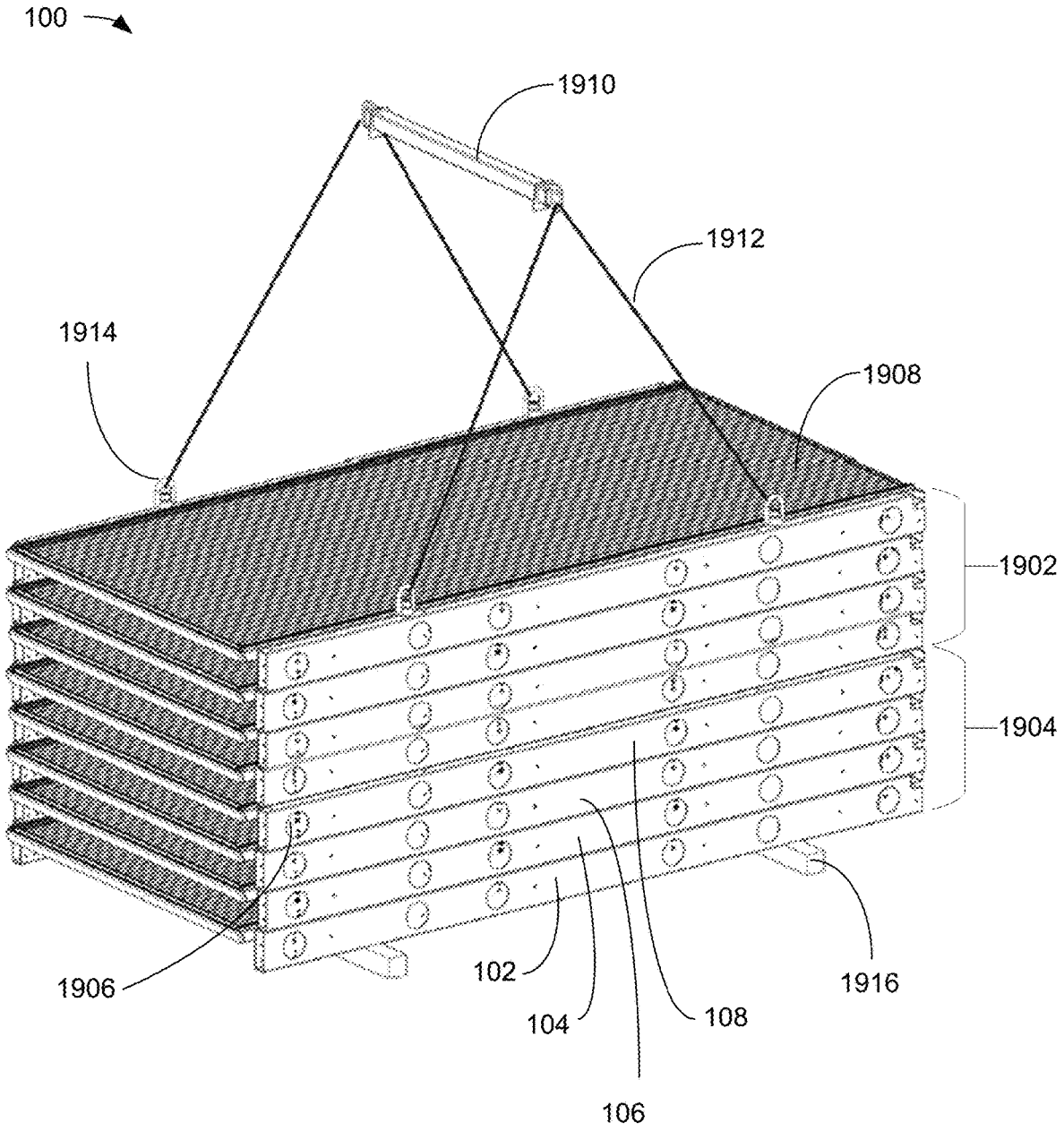
FIG. 19 is a perspective view illustrating an exemplary shipping stack of two of the exemplary improved foldable prefabricated building section frames of FIG. 1, with exemplary panels installed, according to a preferred embodiment of the present invention.

FIG. 19 is a perspective view illustrating an exemplary shipping stack of two of the exemplary improved foldable prefabricated building section frames 100 of FIG. 1, with exemplary panels 1908 installed, according to a preferred embodiment of the present invention. Foldable building sections 1902 and 1904 are held together via packaging bolts 1906 and are lifted by a crane using a spreader bar 1910, cables 1912 (one of four labeled), and attachment hardware 1914 (one of four labeled). Dunnage 1916 provides access to fork lifts.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A frame for a sectional foldable prefabricated building comprising:

a. a plurality of tubular columns of rectangular cross section, each tubular column having:

i. first and second linear arrays of castellated holes on respective first and second opposing long sides of each tubular column of said plurality of tubular columns; and ii. wherein said castellated holes on said first long side of said tubular column are not all aligned, transversely to a long axis of said tubular column, to said castellated holes on said second opposing side of said tubular column; and b. a plurality of tubular rafters of rectangular cross section, each tubular rafter having:

i. first and second linear arrays of castellated holes on respective first and second opposing long sides of each tubular rafter of said plurality of tubular rafters; and ii. wherein said castellated holes on said first long side of said tubular rafter are not all aligned, transversely to a long axis of said tubular rafter, to said castellated holes on said second opposing long side of said tubular rafter;

c. a plurality of base plates securing said plurality of tubular columns to a foundation wherein each baseplate of said plurality of baseplates comprises two pairs of parallel spaced-apart vertical flanges wherein each pair is configured to fit within one column of said plurality of columns; and d. a plurality of corner joints hingedly connecting respective top ends of said plurality of tubular columns to respective lower ends of said plurality of tubular rafters.

2. The frame for a sectional foldable prefabricated building of claim 1, comprising:

a. said castellated holes each having two long straight sides and convex semi-circular short sides; and b. said tubular rafters of rectangular cross section and said tubular columns of rectangular cross section having rounded long edges.

3. The frame for a sectional foldable prefabricated building of claim 1, comprising:

a. first and second tubular columns of said plurality of tubular columns configured spaced apart, parallel, and connected by a plurality of bolted-on girts to form a first wall frame;

b. third and fourth tubular columns of said plurality of columns configured spaced apart, parallel, and connected by a plurality of bolted-on girts to form a second wall frame;

c. wherein said first and second tubular columns in said first wall frame each has an inwardly facing, relative to said first wall frame, long side having a plurality of said castellated holes;

d. wherein said first and second tubular columns in said first wall frame each has an outwardly facing, relative to said first wall frame, long side having an array of said castellated holes;

e. wherein a first pair of said two pairs of parallel spaced-apart vertical flanges is configured one of:

1. parallel to a second pair of said two pairs of parallel spaced-apart vertical flanges; and 2. perpendicular to a second pair of said two pairs of parallel spaced-apart vertical flanges; and f. each flange of said vertical flanges further comprising at least one bolt hole.

4. The frame for a sectional foldable prefabricated building of claim 3, comprising:

a. first and second tubular rafters of said plurality oftubular rafters configured spaced apart, parallel, and connected by a plurality of bolted-on purlins to form a first roof frame;

b. third and fourth tubular rafters of said plurality of tubular rafters configured spaced apart, parallel, and connected by a plurality of bolted-on purlins to form a second roof frame;

c. wherein said first and second tubular rafters in said first roof frame each has an inwardly facing, relative to said first roof frame, long side having a plurality of said castellated holes; and d. wherein said first and second tubular rafters in said first roof frame each has an outwardly facing, relative to said first roof frame, long side having a plurality of said castellated holes.

5. The frame for a sectional foldable prefabricated building of claim 4, comprising:

a. a plurality of girt attachment bolt holes in each said inwardly facing long side of each said tubular column; and b. a plurality of purlin attachment bolt holes in each said inwardly facing long side of each said tubular rafter.

6. The frame for a sectional foldable prefabricated building of claim 4, comprising:

a. a plurality of attachment bolt holes on said inwardly facing side of each tubular rafter for crane lifting;

b. at least one bolt hole in said ridge plate for crane lifting; and c. a plurality of attachment bolt holes on said inwardly facing side of each tubular column for crane lifting.

7. The frame for a sectional foldable prefabricated building of claim 4, comprising:

a. a second wall frame having the same features as said first wall frame; and b. a second roof frame having the same features as said first roof frame.

8. The frame for a sectional foldable prefabricated building of claim 7, comprising:

a. first and second corner joints of said plurality of corner joints between first and second top ends of said first and second tubular columns of said first wall frame and first and second lower ends of said first and second tubular rafters of said first roof frame;

b. third and fourth corner joints of said plurality of corner joints between first and second top ends of said third and fourth tubular columns of said second wall frame and first and second lower ends of said third and fourth tubular rafters of said second roof frame;

c. first and second ridge joints between top ends of said first and second tubular rafters of said first roof frame and top ends of said third and fourth tubular rafters of said second roof frame;

d. wherein each said joint includes one of a ridge plate and a haunch plate, each having two bolt holes for pivot bolts and a plurality of bolt holes for securing bolts; and e. wherein said pivot bolts are configured to be made releasably secure.

9. The frame for a sectional foldable prefabricated building of claim 8, comprising:

a. a corner brace attachment bolt hole in each said inwardly facing long side of each said tubular column;

b. first and second corner brace attachment bolt holes in each said inwardly facing long side of each said tubular rafter;

c. a corner brace securable between said corner brace attachment bolt holes in each said tubular column and each said tubular rafter which are connected by one said corner joint.

10. The frame for a sectional foldable prefabricated building of claim 8, comprising:

a. first and second ridge brace attachment bolt holes in each said inwardly facing long side of each said tubular rafter; and b. a ridge brace securable between said ridge brace attachment bolt holes in each two said tubular rafters which are connected by one said ridge joint.

11. A frame for a sectional foldable prefabricated building comprising:

a. a plurality of tubular columns of rectangular cross section, each tubular column having:

i. first and second linear arrays of castellated holes on respective first and second opposing long sides of each tubular column of said plurality of tubular columns; and ii. wherein said castellated holes on said first long side of said tubular column are not all aligned, transversely to a long axis of said tubular column, to said castellated holes on said second opposing side of said tubular column;

b. a plurality of tubular rafters of rectangular cross section, each tubular rafter having:

i. first and second linear arrays of castellated holes on respective first and second opposing long sides of each tubular rafter of said plurality of tubular rafters; and ii. wherein said castellated holes on said first long side of said tubular rafter are not all aligned, transversely to a long axis of said tubular rafter, to said castellated holes on said second opposing long side of said tubular rafter;

c. a plurality of base plates securing said plurality of tubular columns to a foundation wherein each baseplate of said plurality of baseplates comprises two pairs of parallel spaced-apart vertical flanges, wherein each pair is configured to fit within one column of said plurality of columns; and d. a plurality of corner joints hingedly connecting respective top ends of said plurality of tubular columns to respective lower ends of said plurality of tubular rafters;

e. wherein a first pair of said two pairs of parallel spaced-apart vertical flanges is configured one of:

1. Parallel to a second pair of said two pairs of parallel spaced-apart vertical flanges; and 2. Perpendicular to a second pair of said two pairs of parallel spaced-apart vertical flanges; and f. each flange of said vertical flanges further comprising at least one through hole.

12. The frame for a sectional foldable prefabricated building of claim 11, comprising:

a. first and second tubular columns of said plurality of tubular columns configured spaced apart, parallel, and connected by a plurality of bolted-on girts to form a first wall frame;

b. third and fourth tubular columns of said plurality of columns configured spaced apart, parallel, and connected by a plurality of bolted-on girts to form a second wall frame;

c. wherein said first and second tubular columns in said first wall frame each has an inwardly facing, relative to said first wall frame, long side having a plurality of said castellated holes; and d. wherein said first and second tubular columns in said first wall frame each has an outwardly facing, relative to said first wall frame, long side having a plurality of said castellated holes;

e. first and second tubular rafters of said plurality oftubular rafters configured spaced apart, parallel, and connected by a plurality of bolted-on purlins to form a first roof frame;

f. third and fourth tubular rafters of said plurality of tubular rafters configured spaced apart, parallel, and connected by a plurality of bolted-on purlins to form a second roof frame;

g. wherein said first and second tubular rafters in said first roof frame each has an inwardly facing, relative to said first roof frame, long side having a plurality of said castellated holes; and h. wherein said first and second tubular rafters in said first roof frame each has an outwardly facing, relative to said first roof frame, long side having a plurality of said castellated holes.

13. The frame for a sectional foldable prefabricated building of claim 12, comprising:

a. a plurality of attachment bolt holes on said inwardly facing side of each tubular rafter for crane lifting;

b. at least one bolt hole in said ridge plate for crane lifting;

c. a plurality of attachment bolt holes on said inwardly facing side of each tubular column for crane lifting; and d. said tubular rafters of rectangular cross section and said tubular columns of rectangular cross section having rounded long edges.

14. The frame for a sectional foldable prefabricated building of claim 12, comprising:

a. a second wall frame having the same features as said first wall frame;

b. a second roof frame having the same features as said first roof frame;

c. first and second corner joints of said plurality of corner joints between first and second top ends of said first and second tubular columns of said first wall frame and first and second lower ends of said first and second tubular rafters of said first roof frame, respectively;

d. third and fourth corner joints of said plurality of corner joints between first and second top ends of said third and fourth tubular columns of said second wall frame and first and second lower ends of said third and fourth tubular rafters of said second roof frame, respectively;

e. first and second ridge joints between top ends of said first and second tubular rafters of said first roof frame and top ends of said third and fourth tubular rafters of said second roof frame;

f. wherein each said joint includes one of a ridge plate and a haunch plate, each having two bolt holes for pivot bolts and a plurality of bolt holes for securing bolts; and g. wherein said pivot bolts are configured to be made releasably secure.

15. The frame for a sectional foldable prefabricated building of claim 14, comprising:

a. a plurality of girt attachment bolt holes in each said inwardly facing long side of each said tubular column; and b. a plurality of purlin attachment bolt holes in each said inwardly facing long side of each said tubular rafter.

16. The frame for a sectional foldable prefabricated building of claim 15, comprising:

a. first and second corner brace attachment bolt holes in each said inwardly facing long side of each said tubular column;

b. first and second corner brace attachment bolt holes in each said inwardly facing long side of each said tubular rafter; and c. a corner brace securable between said corner brace attachment bolt holes in each said tubular column and each said tubular rafter which are connected by one said corner joint.

17. The frame for a sectional foldable prefabricated building of claim 16, comprising:

a. first and second ridge brace attachment bolt holes in each said inwardly facing long side of each said tubular rafter; and b. a ridge brace securable between said ridge brace attachment bolt holes in each two said tubular rafters which are connected by one said ridge joint.

18. A frame for a sectional foldable prefabricated building comprising:

a. a plurality of tubular columns of rectangular cross section, each tubular column having:

i. first and second arrays of castellated holes on respective first and second opposing long sides of each tubular column of said plurality of tubular columns; and ii. wherein said castellated holes on said first long side of said tubular column are not all aligned, transversely to a long axis of said tubular column, to said castellated holes on said second opposing side of said tubular column; and b. a plurality of tubular rafters of rectangular cross section, each tubular rafter having:

i. first and second arrays of castellated holes on respective first and second opposing long sides of each tubular rafter of said plurality of tubular rafters;

ii. wherein said castellated holes on said first long side of said tubular rafter are not all aligned, transversely to a long axis of said tubular rafter, to said castellated holes on said second opposing long side of said tubular rafter;

c. a plurality of base plates securing said plurality of tubular columns to a foundation wherein each baseplate of said plurality of baseplates comprises two pairs of parallel spaced-apart vertical flanges, wherein each pair is configured to fit within one column of said plurality of columns; and d. a plurality of corner joints hingedly connecting respective top ends of said plurality of tubular columns to respective lower ends of said plurality of tubular rafters;

e. wherein a first pair of said two pairs of parallel spaced-apart vertical flanges is configured one of:

1. Parallel to a second pair of said two pairs of parallel spaced-apart vertical flanges; and 2. perpendicular to a second pair of said two pairs of parallel spaced-apart vertical flanges;

f. each flange of said vertical flanges further comprising at least one through hole; and g. said tubular rafters of rectangular cross section and said tubular columns of rectangular cross section having rounded long edges.

19. The frame for a sectional foldable prefabricated building of claim 18, comprising:

a. first and second tubular columns of said plurality of tubular columns configured spaced apart, parallel, and connected by a plurality of bolted-on girts to form a first wall frame;

b. third and fourth tubular columns of said plurality of columns configured spaced apart, parallel, and connected by a plurality of bolted-on girts to form a second wall frame;

c. wherein said first and second tubular columns in said first wall frame each has an inwardly facing, relative to said first wall frame, long side having a plurality of said castellated holes;

d. wherein said first and second tubular columns in said first wall frame each has an outwardly facing, relative to said first wall frame, long side having a plurality of said castellated holes;

e. first and second tubular rafters of said plurality of tubular rafters configured spaced apart, parallel, and connected by a plurality of bolted-on purlins to form a first roof frame;

f. third and fourth tubular rafters of said plurality of tubular rafters configured spaced apart, parallel, and connected by a plurality of bolted-on purlins to form a second roof frame;

g. wherein said first and second tubular rafters in said first roof frame each has an inwardly facing, relative to said first roof frame, long side having a plurality of said castellated holes;

h. wherein said first and second tubular rafters in said first roof frame each has an outwardly facing, relative to said first roof frame, long side having a plurality of said castellated holes;

i. a second wall frame having the same features as said first wall frame; and j. a second roof frame having the same features as said first roof frame;

k. first and second corner joints of said plurality of corner joints between first and second top ends of said first and second tubular columns of said first wall frame and first and second lower ends of said first and second tubular rafters of said first roof frame;

l. third and fourth corner joints of said plurality of corner joints between first and second top ends of said third and fourth tubular columns of said second wall frame and first and second lower ends of said third and fourth tubular rafters of said second roof frame;

m. first and second ridge joints between top ends of said first and second tubular rafters of said first roof frame and top ends of said third and fourth tubular rafters of said second roof frame;

n. wherein each said joint includes one of a ridge plate and a haunch plate, each having two bolt holes for pivot bolts and a plurality of bolt holes for securing bolts; and o. wherein said pivot bolts are configured to be made releasably secure.

20. The frame for a sectional foldable prefabricated building of claim 19, comprising:

a. a plurality of attachment bolt holes on said inwardly facing side of each tubular rafter for crane lifting;

b. at least one bolt hole in said ridge plate for crane lifting; and c. a plurality of attachment bolt holes on said inwardly facing side of each tubular column for crane lifting.

* * * * *